US009460619B2

(12) United States Patent
Kowalski

(10) Patent No.: US 9,460,619 B2
(45) Date of Patent: Oct. 4, 2016

(54) METHODS AND SYSTEMS FOR CONTROLLING TRAFFIC FLOW

(75) Inventor: Gregory Mikituk Kowalski, Conshohocken, PA (US)

(73) Assignee: The Boeing Company, Chicago, IL (US)

( * ) Notice: Subject to any disclaimer, the term of this patent is extended or adjusted under 35 U.S.C. 154(b) by 2839 days.

(21) Appl. No.: 11/624,090

(22) Filed: Jan. 17, 2007

(65) Prior Publication Data

US 2008/0172171 A1 Jul. 17, 2008

(51) Int. Cl.
*G08G 1/056* (2006.01)
*G08G 1/065* (2006.01)
*G08G 1/07* (2006.01)

(52) U.S. Cl.
CPC ..... *G08G 1/065* (2013.01); *G08G 1/07* (2013.01)

(58) Field of Classification Search
CPC ..... G08G 1/0104; G08G 1/09; G08G 1/142
USPC ..... 701/118, 117, 41, 301, 410, 411, 421, 701/423, 532, 533; 348/143, 149; 340/903, 340/905, 933, 934, 995.12
See application file for complete search history.

(56) References Cited

U.S. PATENT DOCUMENTS

| | | | | |
|---|---|---|---|---|
| 4,744,026 | A | 5/1988 | Vanderbei | |
| 5,172,321 | A | 12/1992 | Ghaem et al. | |
| 5,610,821 | A | 3/1997 | Gazis et al. | |
| 6,609,061 | B2 | 8/2003 | MacPhail et al. | |
| 6,850,171 | B2 | 2/2005 | Mathias | |
| 2002/0145541 | A1* | 10/2002 | Matsui et al. | 340/934 |
| 2002/0174077 | A1* | 11/2002 | Yui et al. | 705/400 |
| 2003/0060966 | A1* | 3/2003 | MacPhail et al. | 701/117 |
| 2003/0060969 | A1* | 3/2003 | Waite et al. | 701/117 |
| 2005/0164673 | A1* | 7/2005 | Ehlers | 455/404.1 |
| 2006/0019679 | A1 | 1/2006 | Rappaport et al. | |
| 2006/0095199 | A1 | 5/2006 | Lagassey | |
| 2006/0170565 | A1 | 8/2006 | Husak et al. | |
| 2006/0212219 | A1* | 9/2006 | Okada et al. | 701/211 |
| 2007/0213922 | A1* | 9/2007 | Van Buer et al. | 701/117 |
| 2007/0244627 | A1* | 10/2007 | Boss et al. | 701/117 |

* cited by examiner

*Primary Examiner* — Redhwan K Mawari
*Assistant Examiner* — Rodney King
(74) *Attorney, Agent, or Firm* — Armstrong Teasdale LLP

(57) ABSTRACT

Methods and systems for controlling vehicular traffic flow in a transport system are provided. The method includes defining a plurality of queues through the transport system, assigning each of a plurality of vehicles into one of the plurality of queues, determining a number of vehicles in each queue and a period of time each vehicle remains in the queue, and permitting traffic flow in at least one queue that facilitates reducing the congestion of the plurality of queues.

26 Claims, 3 Drawing Sheets

METHODS AND SYSTEMS FOR CONTROLLING TRAFFIC FLOW

BACKGROUND OF THE INVENTION

This invention relates generally to methods and systems for controlling traffic flow and more particularly, to methods and systems for controlling traffic flow using RFID enabled devices.

Traffic flow at street intersections is generally controlled with light signal systems. A light signal system includes a combination of light signal transmitters for various roads approaching the intersection and the required operating devices for controlling the traffic flow. A light signal transmitter may be a transmitting apparatus that transmits visible signals to the traffic participants such as a traffic light. A signal program executes in a local control device for the intersection, in which the signal times for the light signal system are fixed with respect to duration and assignment. At least some known light signal systems are fixed time controlled and others may use traffic-dependent methods for controlling the signal transmitters at an intersection.

The fixed time signal control is a light-signal control with fixed signal times, without an influencing option for the traffic flow. This signal control is based on taking into account the long-term traffic situation at the intersection. The method uses signal programs, operating on the basis of fixed-time tables, with a rigid sequence of automatic operations. Fixed-time controlled methods are relatively inexpensive, but are not flexible over the short run or the long run with respect to changes in the traffic conditions at the intersection.

Traffic-dependent methods take into account short-term traffic situations at the intersection and usually require several detectors, such as induction loops, infrared sensors, or radar detectors for each approach to the intersection. As a result, these control methods are very flexible in the short term, but have only an average flexibility for the long term, so that additional planning becomes necessary. On the whole, these traffic-dependent methods are expensive and require extensive pre-planning to implement.

In addition, the known systems are not able to detect congestion at an intersection and therefore can not reduce congestion of traffic flow through the intersection.

BRIEF DESCRIPTION OF THE INVENTION

In one embodiment, a computer-implemented method of controlling vehicular traffic flow in a transport system includes defining a plurality of queues through the transport system, assigning each of a plurality of vehicles into one of the plurality of queues, determining congestion in each queue, and permitting traffic flow in at least one queue that facilitates reducing the congestion of the plurality of queues.

In another embodiment, a radio frequency identification (RFID) enabled system for traffic flow control includes a plurality of vehicles including at least one RFID enabled device mounted thereon, a reader of the RFID enabled devices configured to determine a location of the RFID enabled device. The system also includes a processor communicatively coupled to the reader wherein the processor is configured to determine a plurality of queues through which the traffic flow is routed, assign each RFID enabled device to a queue, determine a congestion in each queue based on a number of vehicles in the queue and an amount of time the vehicle is in the queue, and control the traffic flow such that at least one of congestion in a queue and total congestion in a plurality of queues is facilitated being reduced.

In yet another embodiment, a method of controlling vehicular traffic flow through an intersection of roads includes determining a queue for each possible track of travel through the intersection, determining congestion in each queue, and permitting flow in one or more queues such that congestion is facilitated being minimized.

DETAILED DESCRIPTION OF THE INVENTION

Figure 1:
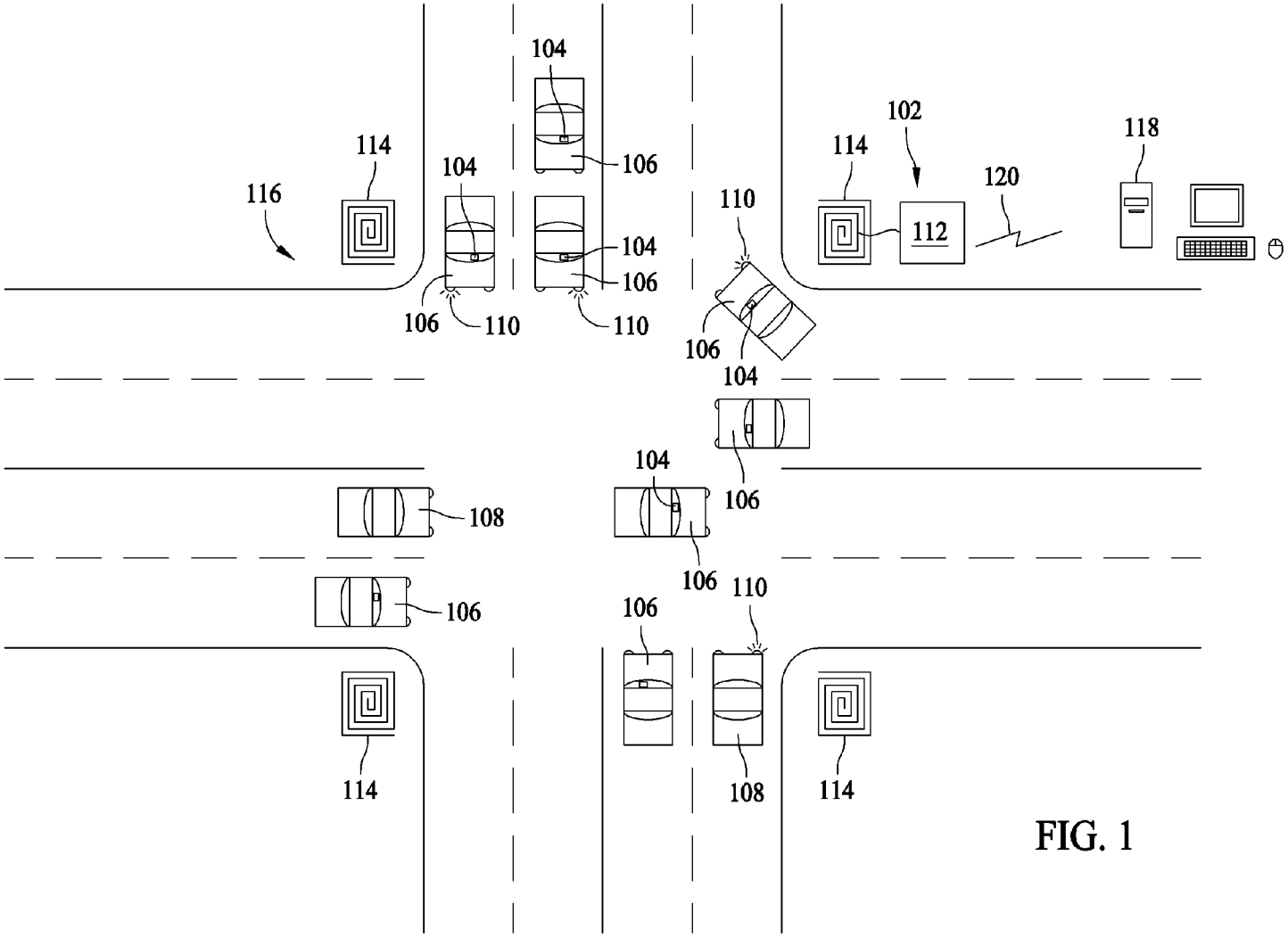
FIG. 1 is a block diagram of an exemplary embodiment of a traffic control system in accordance with an exemplary embodiment of the present invention.

FIG. 1 is a block diagram of an exemplary embodiment of a traffic control system 100 in accordance with an exemplary embodiment of the present invention. In the exemplary embodiment, system 100 includes an RFID reader 102 capable of interrogating a plurality of RFID enabled devices 104 such as RFID tags coupled to a vehicle 106 to uniquely identify the vehicle to system 100. In other embodiments, traffic control system 100 includes a real-time location system other than an RFID system that is capable of performing the functions described herein. In some instances, a non-participatory vehicle 108 such as a vehicle that does not include a RFID enabled device 104 or includes an RFID enabled device that is nonfunctional may be interspersed with vehicles 106. Because vehicle 108 contributes to congestion but is unknown to system 100, system 100 may include an algorithm to estimate or infer the presence of vehicles 108 and correct the control outputs of system 100 to account for the presence of vehicles 108.

System 100 uses an active RFID system with active RFID enabled devices 104. RFID enabled devices 104 may be installed as an OEM system or could be installed on existing vehicles as an after-market accessory. In the exemplary embodiment, RFID enabled device 104 is attached to a windshield of vehicle 106. In other embodiments, RFID enabled devices 104 may be formed into hood ornaments, appliqués, decals, and other desirable fashion accoutrements and coupled to vehicle 106 by adhesion, magnetics, or fasteners. Because RFID enabled devices 104 transmit and receive radio frequency signals they can often experience interference in high metal density environments and therefore vehicle RFID enabled devices 104 are generally positioned on or near the windshield of vehicle 106. Most vehicle glass atomic structure permits electromagnetic waves in the visible light spectrum and lower frequency waves such as radio frequency waves to pass through the glass unimpeded.

A line of sight is not required between RFID enabled device 104 and an associated reader 102 for RFID enabled devices 104 to communicate with reader 102 and the active RFID feature of system 100 permits relatively greater accuracy and greater read distances, a weatherproof RFID enabled device 104 could be positioned on a exterior of vehicle 106 without interfering with driver vision. In another embodiment, exterior placement of RFID enabled devices 104 permits vehicle OEMs to preinstall RFID enabled devices 104 and hardwire them to a turn signal circuit 110 of vehicle 106 such that an intended track of vehicle 106 is capable of being transmitted to reader 102 with or without cosmetic changes. Forming RFID enabled devices 104 into marketable shapes and designs provides an opportunity to market RFID enabled devices 104 as desirable cosmetic additions to personal vehicles 106.

Reader 102 includes an electronics module 112 and at least one antenna 114. In the exemplary embodiment, reader 102 includes one electronics module 112 and four antennae 114. Other configurations of readers and antennae could be incorporated in other embodiments of the present invention. Reader 102 and associated antennae are mounted at predetermined positions at for example, an intersection 116 of roads. Placement of antennae 114 and readers 102 are determined by for example, readability. Antennae 114 and readers 102 are placed at various locations throughout an intersection based on locations that facilitate generating accurate readings of RFID enabled devices 104 in all directions. In addition consideration may be made to minimize the amount of hardware infrastructure used at each intersection. Generally the configuration is based on an empirical study of intersection 116. Although unique characteristics of each intersection 116 generally preclude a single configuration for each intersection 116, predetermined standards aid in hardware placement. Reader 102 includes a capability to network multiple antennae 114 coupled to reader 102. Because only three antennae are necessary to triangulate a signal and determine a location of vehicle 106, a single reader 102 is used at a typical four way intersection to determine the location of any vehicle within range. Using a single reader 102 when possible and multiple networked antennae provides a cost effective implementation and still permit additional antennae as required for customization of the environment at each intersection 116.

After placement of readers 102 and antennae 114, reader 102 is communicatively coupled to all antennae 114. Reader 102 is communicatively coupled to a server 118 through a communications link 120. Link 120 may be a hardwired, wireless, or multi-mode link. Server 118 receives raw data and/or preprocessed information from each reader 102 communicatively coupled to server 118. Server 118 executes traffic control application software that processes the raw data and/or preprocessed information to generate traffic control signals that facilitate reducing congestion of vehicles in a queue at each intersection, in the intersection as a whole, in a network of intersections.

When installed, all hardware at an intersection is calibrated. Knowledge of vehicle 106 intended direction is an important feature of system 100. Available RFID hardware is capable of locating active tags within a few feet. Accordingly an intended direction of vehicle 106 may be identified by its lane location. Calibration of system 100 hardware establishes how readers 102 are positioned about intersection 116. For example, circumscribing a periphery of each traffic lane with a special calibration tag and noting each lane's designated direction such as a left turn only lane or choices of directions such as a right turn or straight thereby associating any vehicle within a lane with selectable destination choices. System 100 also ignores vehicles outside of boundaries of all lanes as non-participants in system 100. For example, a vehicle parked at the side of the road or in a driveway is not counted as being in a queue.

Mathematical models are idealized representations expressed in terms of mathematical symbols and expressions. If there are n related quantifiable decisions to be made, they may be represented as decision variables (x1, x2, x3 . . . xn) whose values must be determined. A measure of performance may then be expressed as a mathematical function of these decision variables and is called an objective function. Restrictions to these decision variables may also be expressed mathematically and are called constraints. A process called sensitivity analysis is usually performed to determine how the model would change as the values assigned to the decision variables were changed to other feasible solutions.

System 100 is a traffic flow optimization solution that utilizes active radio frequency identification technology along with linear programming and statistical routines to minimize vehicle wait time at intersections, increase road capacity and consumer fuel economy, reduce vehicle congestion and pollution caused by congestion, and provide vehicle data for future planning using existing technology with minimal infrastructure investment and consumer expense.

In a typical RFID system such as reader 102 and RFID enabled device 104, individual objects are equipped with a small, inexpensive tag containing RFID enabled device 104. The tag contains a transponder with a digital memory chip that stores an electronic code that is unique to that tag. Reader 102 includes one or more antennae packaged with a transceiver and a decoder, emits an electromagnetic signal that activates RFID enabled device 104 by passing over its antenna and generating a return radio frequency electromagnetic signal that can be interpreted by reader 102. Reader 102 decodes the data encoded in the tag's integrated circuit and the data is passed to server 118. Application software on server 118 processes the data, and may perform various filtering operations to reduce the numerous often redundant reads of the same tag to a smaller and more useful data set.

Passive RFID tags have no internal power supply. The electrical current induced in the antenna by the incoming radio frequency signal provides enough power for the integrated circuit (IC) in the tag to power up and transmit a response. Most passive tags signal by backscattering the carrier signal from the reader. This means that the antenna is designed to both collect power from the incoming signal and also to transmit the outbound backscatter signal. The response of a passive RFID tag may include a unique ID number and data that may be stored in a nonvolatile EEPROM. Lack of an onboard power supply means that the device can be quite small. For example, some known RFID ICs measure 0.15 mm×0.15 mm, and are less than 7.5 micrometers thick. RFID tags are inexpensive as well, costing only a fraction of a dollar. The addition of the antenna creates a tag that varies from the size of a postage stamp to the size of a post card. Passive tags have practical read distances ranging from about 4 in. up to a few dozen feet depending on the chosen radio frequency and antenna design/size. Due to their simplicity in design antennas may be manufactured through a printing process. Passive RFID tags do not require batteries, can be much smaller, and have an unlimited life span. Non-silicon tags made from polymer semiconductors are also available.

Unlike passive RFID tags, active RFID tags have their own internal power source which is used to power any ICs that generate a transmitted signal. Active tags are typically much more reliable than passive tags due to the ability for active tags to conduct a "session" with a reader. Active tags, due to their onboard power supply, also transmit at higher power levels than passive tags, allowing them to be more effective in "RF challenged" environments like water (including humans/cattle, which are mostly water), metal (shipping containers, vehicles), or at longer distances. Many active tags have practical ranges of hundreds of meters, and a battery life of up to 10 years. Active tags typically have much longer range (approximately 300 feet) and larger memories than passive tags, as well as the ability to store additional information sent by reader 102.

Figure 2:
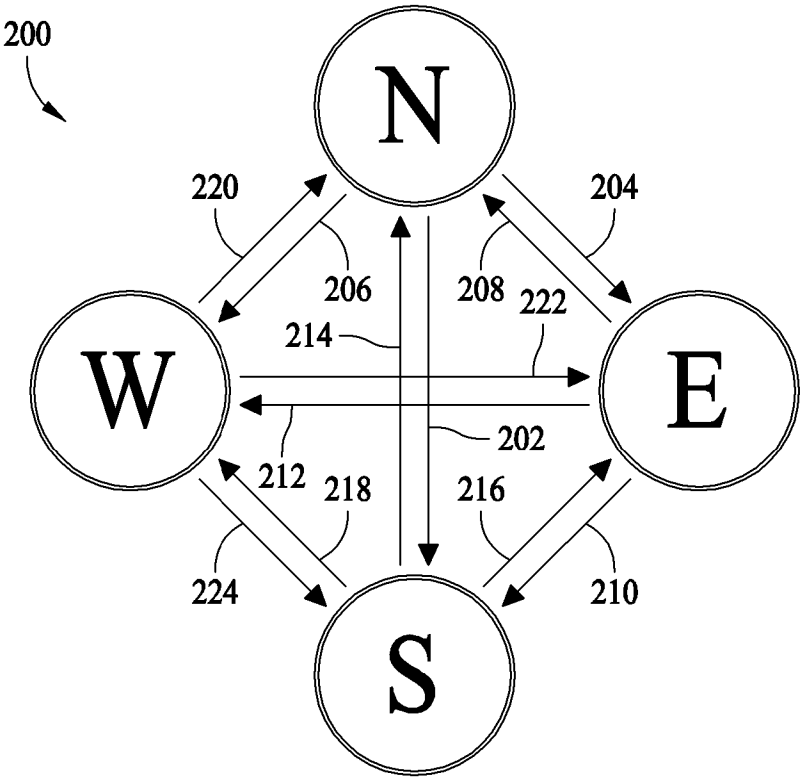
FIG. 2 is a schematic diagram of an exemplary embodiment of a standard four way intersection including twelve queues for vehicles.

FIG. 2 is a schematic diagram of an exemplary embodiment of a standard four way intersection 200 including twelve queues for vehicles. In the exemplary embodiment, intersection 200 includes a North to South queue 202, a North to East queue 204, a North to West queue 206, a East to North queue 208, a East to South queue 210, a East to West queue 212, a South to North queue 214, a South to East queue 216, a South to West queue 218, a West to North queue 220, a West to East queue 222, and a West to South queue 224. For purposes of some calculations the intersection itself may be considered a queue. The number of queues for an intersection of any number of two way origins and destinations can be represented by the equation [X number of directions * (X number of directions−1)].

System 100 comprises a solution to an increasing number of vehicles on the roads using growingly insufficient roadway capacity. When system 100 is activated a vehicle queue sequence is started. The vehicle queue sequence is responsible for transmitting appropriate data to the optimization and statistical sequences. As described above, the hardware may be calibrated upon start-up to establish roadway boundaries. As a vehicle approaches intersection 200 RFID enabled device 104 transmits an identification unique to that devise 104. The vehicles current location and intended direction are determined through either location and turn signal, or lane location as it approaches intersection 200. For any standard four way intersection there are a finite number of possible origins and destinations. As shown in FIG. 2, each arrow represents a potential origin and destination and therefore a potential queue of vehicles.

Once the queue system is no longer null (has values >0) the following variables are continuously calculated:

Time of vehicle $i$ ($v_i$) in queue $x_i = Tv_i$

Sum total vehicles for each $x_i = Nx_i$

Sum total time for each $x_i = Wx_i$

Calculate average time between arrivals $= \lambda_i$

Upon detection, a vehicle is placed in a first queue associated with its determined location and all variables are calculated. When the vehicle passes into the intersection it is logged as being in the intersection queue. When the vehicle passes through the intersection it appears in a different lane and its location is determined and it is placed in a second queue. However, the queue system continuously checks for vehicles with multiple records by looking for an identical identification number on any new entry. When an identical number is found, the vehicle has passed through the intersection and all associated data may be deleted for $v_i$ in all $x_i$ and all variables re-calculated. An exception to this rule is made for the intersection queue which is necessary to execute a Grid-lock function as described below. In this sequence duplicates may exist in the intersection queue until a vehicle's tag identification is placed in multiple $x_i$.

Figure 3:
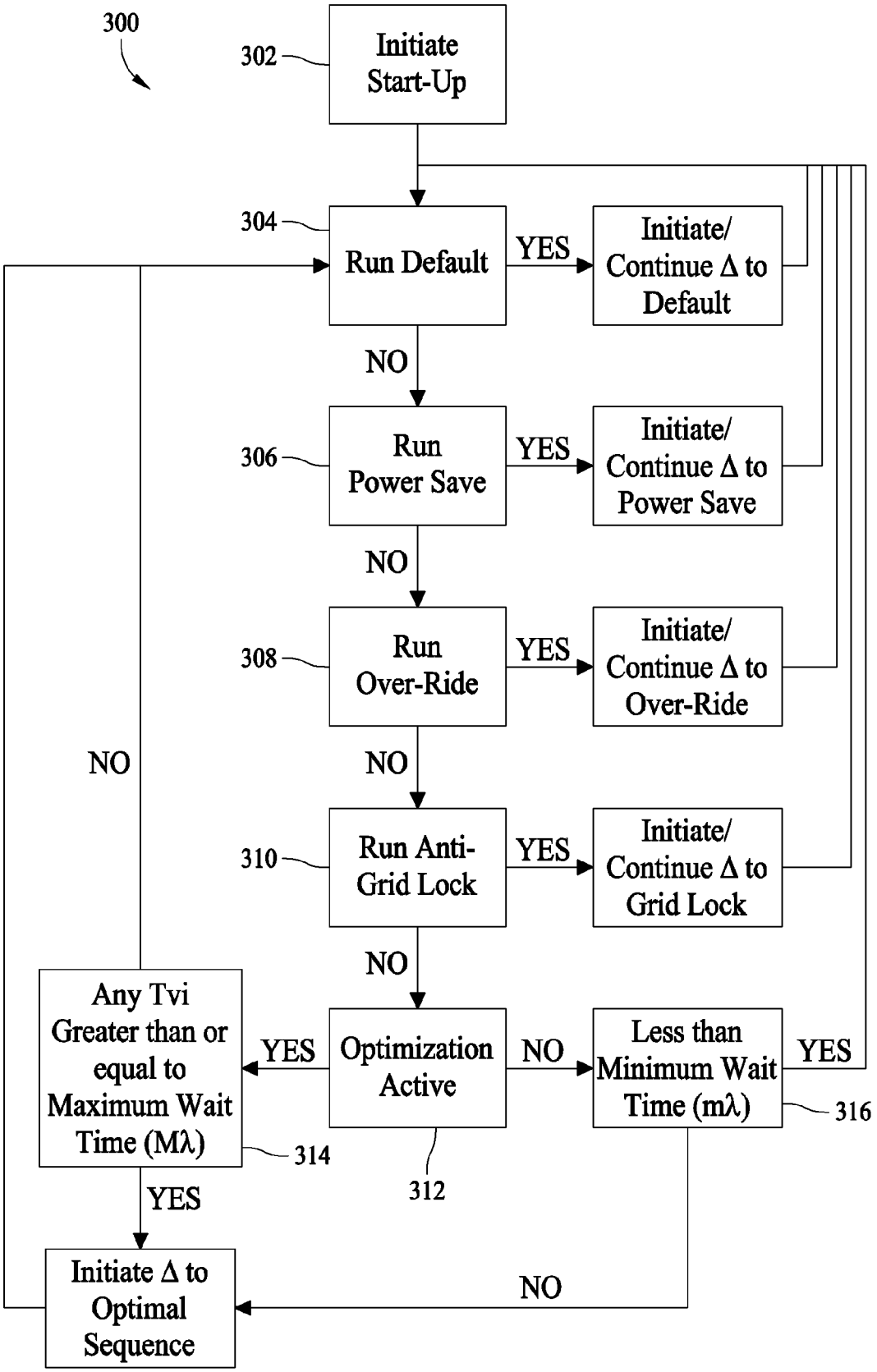
FIG. 3 is a flow diagram of an exemplary queue maintenance sequence that may be used with the system shown in FIG. 1.

FIG. 3 is a flow diagram of an exemplary queue maintenance sequence 300 that may be used with system 100 (shown in FIG. 1). System 100 steps through queue maintenance sequence 300 to determine when vehicles and their associated data are added and removed from system 100.

Upon successful start-up 302 of system 100, the program will run through a continuous loop of sequences, each customizable for a community or environment. Queue maintenance sequence 300 includes a default sequence 304 that initiates certain parameters and ensures continuous operation despite any potential software or hardware failures. These parameters may be customized, however conditions that may initiate default sequence 304 include:

System 100 is available but the Department of Transportation does not yet want to begin the optimization and statistical routines.

System 100 has detected corruption in its data and while it clears and replaces data from the queues must resort to a traffic pattern routine.

A power save sequence 306 is customizable, however conditions that may initiate power save sequence 306 include:

The average time between arrivals, λi is sufficiently low such that it is not necessary to run lights continuously, rather it would be possible to flash red and yellow on some non-continuous frequency.

The average time between arrivals, λi is sufficiently low such that it would be possible to avoid using additional turn signal lights.

The energy savings from using power save sequence 306 on any individual intersection is small but collectively over an entire geographic area is potentially significant.

An over-ride sequence 308 is reserved for emergency and select public vehicles. System 100 permits police, ambulance, and fire vehicles to pass through intersections unimpeded by transmitting a signal that is received through an existing receiver at the intersection or directly from the emergency vehicle. in one embodiment system 100 is linked to a satellite navigation system (not shown) that coordinates emergency vehicle destinations with over-ride sequence 308 to identify the fastest route to the destination and sequence traffic control devices to permit unimpeded passage through all intersections.

An anti-grid lock sequence 310 determines when vehicles are blocking an intersection and will permit the blocking vehicles to clear the intersection before permitting traffic to resume travel through the intersection. System 100 is calibrated to identify vehicles in their approaching lanes and determine an amount of time the vehicle remains in that lane. System 100 also determines when vehicles enter the intersection and how long the vehicle remains in the intersection. If during an optimization sequence the maximum wait time (Mλ) is exceeded and there is at least one vehicle in the intersection, anti-grid lock sequence 310 engages until the vehicles clear the intersection and RFID enabled device 104 identities are deleted from all queues. System 100 including a reader 102 deployed on an adjacent intersection is capable of taking advantage of road capacity constraints to avoid grid-lock all together.

In each sequence, system 100 conducts a continuous loop check. If system 100 bypasses all other sequences, for example, run all other sequences="No," then an optimization sequence 312 initiates. Optimization sequence 312 includes a model of the traffic flow in system 100 and the form of the model is described below:

Maximize $Z = \Sigma Wx_i$; where $Wx_i = Wx_{ns} + Wx_{ne} + Wx_{nw} + Wx_{en} + Wx_{es} + Wx_{ew} + Wx_{sn} + Wx_{se} + Wx_{sw} + Wx_{wn} + Wx_{we} + Wx_{ws}$, and the model is subject to the following constraints:

$$0 \le x_n \le 1 \quad \text{(a)}$$

$$x_{ns}+x_{sw} \le 1,\ x_{sn}+x_{ne} \le 1,\ x_{ew}+x_{wn} \le 1,\ x_{we}+x_{es} \le 1 \quad \text{(b)}$$

$$x_{ns}+x_{ws} \le 1,\ x_{sn}+x_{en} \le 1,\ x_{ew}+x_{nw} \le 1,\ x_{we}+x_{se} \le 1 \quad \text{(c)}$$

$$x_{ns} \le x_{ne}+x_{sn},\ x_{sn} \le x_{ns}+x_{sw},\ x_{ew} \le x_{we}+x_{es},\ x_{we} \le x_{ew}+x_{wn} \quad \text{(d)}$$

$$x_{ne}+x_{se} \le 1,\ x_{es}+x_{ws} \le 1,\ x_{sw}+x_{nw} \le 1,\ x_{wn}+x_{en} \le 1 \quad \text{(e)}$$

$$x_{ns}+x_{ew} \le 1,\ x_{ns}+x_{we} \le 1,\ x_{sn}+x_{ew} \le 1,\ x_{sn}+x_{we} \le 1 \quad \text{(f)}$$

The objective function attempts to identify the queues with the longest summed wait times, $Wx_i$ that do not violate the constraints. The associated computer model interprets the identified queues and permits those vehicles to move as necessary. Although system 100 minimizes vehicle wait time, for the purposes of constructing the model, the objective function is written as a maximization and constraints written in the "less than or equal to" (≤) format.

The purpose of constraints (a) through (f) is to avoid any interfering traffic patterns such as all lights green. Constraint (a) ensures that each vehicle queue is either 0 or 1 meaning it will either be permitted to move vehicles, for example, with a green light or a green arrow or be held for example, with a red light. Constraint (b) ensures that if a left hand turn is permitted to move vehicles the opposing lane of traffic must be held and vice versa, if opposing traffic is permitted to move no left hand turn signal may be given. Constraint (c) ensures that if there is a right hand turn signal it can not be green if interfering traffic is permitted to move. Constraint (d) permits delayed green lights and left hand turns to operate independently depending in optimal conditions. Normally a light with extended green will occur continuously regardless of vehicle traffic. System 100 would permit delayed green while also allowing for the possibility of no delay solely based on maximizing traffic through an intersection. Constraint (e) ensures that if there is a right hand turn light you can not have both a right hand turn and a left hand turn traveling to the same lane. Lastly, constraint (f) ensures that opposite direction traffic traveling straight can not occur simultaneously.

A common method to solve linear mathematical models is the Simplex Method. The Simplex Method uses an iterative algorithm with the following structure:

Initialization, test for optimality, continue until current feasible solution optimal.

System 100 software also includes statistical properties. For example, it is possible that an intersection has a high volume in one direction and a relatively very low volume in an opposing direction such that despite an optimized traffic flow a vehicle attempting to proceed in the opposing direction could wait for an impractically excessive amount of time for the light to change. System 100 uses a Poisson distribution to model the number of vehicles that arrive over an interval and uses probability to ensure optimal flow while accounting for all possible scenarios.

In the exemplary embodiment, system 100 assumes that the expected arrivals of vehicles over any time interval in any $x_i$, $E(x_i)$, are equal to $\lambda_i$. This is the basis for calculating minimum and maximum wait times for each $x_i$. When system 100 is running optimize sequence 312, it first checks for optimality. If the optimal sequence is running, system 100 then checks 314 to see if any $Tx_i$ (total sum of vehicles in $x_i$) exceed the maximum wait time as defined by $M\lambda_i$. If so, then a light change would be initiated to permit those vehicles to travel through the intersection. In the exemplary embodiment, $M\lambda_i$ is selectable to represent a maximum total wait time or a maximum vehicle wait time. In the case above, where one direction has high volume and the opposing direction has a low volume, vehicles in the low volume direction would not have to wait indefinitely to cross an intersection that carries an infinite number of vehicles. Road capacity may limit the use of this function because the waiting vehicle's time would continue to increase while the cross road, if filled to capacity with moving vehicles, would have a nearly constant total wait time. Eventually any vehicle would be permitted through any intersection though not in a practical manner.

Once the intersection is changed to a non-optimal route because of $M\lambda_i$ it will not instantaneously change back to the optimal route, again, out of practicality. Instead, as shown at 316, upon change, there is an associated minimum wait time $m\lambda_i$. Minimum wait time, $m\lambda_i$ can be set to any finite number, however, creating a dynamic $m\lambda_i$ allows for optimal flow. The time it takes for a vehicle to travel through the intersection is determined from its change in location over time and an assumption that the time is normally distributed can be made. Because $\lambda_i$ is known, $m\lambda_i$ and $M\lambda_i$ can be set to a value equal to a number of practical constants or dynamic equations based on intersection infrastructure.

Upon calculation of the various $\lambda_i$ the process flow is complete and cycles back to default sequence 304 to continue operation indefinitely. The above discussion assumes each intersection operates independently. However, any number of intersections may be networked together to form a traffic flow solution over a large network of interconnected roads.

It is possible that each intersection in a given area permits optimal vehicle flow. However, independent optimality does not insure collective optimality of a plurality of interconnected intersections. The mathematical model defines what is considered optimal, in this case maximum vehicle flow through a single intersection. Any number of intersections may be networked and represented by a model that defines maximum vehicle flow through the entire network. In such a scenario, wait time at any particular intersection is extended so that the wait at the next intersection is further reduced. A networked model also includes additional constraints such as a capacity constraint that does not permit more vehicles to wait or travel through an intersection than the downstream roads can hold.

The above-described methods and systems for controlling traffic in single or networked intersections using a unique identifier for each vehicle is cost effective and highly reliable. Using RFID enabled devices to locate and identify vehicles entering an intersection permits determining congestion in each queue through the intersection and permits adjusting traffic control signals to facilitate reducing wait times of a vehicle, a queue of vehicles, or all the vehicles approaching the intersection. Signal device control sequences permit a power save option, controlling the signals to permit emergency vehicles to have unimpeded access through the intersection, and a sequence to permit clearing a grid-lock situation in the intersection. Accordingly, the methods and systems facilitate controlling traffic in a cost-effective and reliable manner.

While the invention has been described in terms of various specific embodiments, those skilled in the art will recognize that the invention can be practiced with modification within the spirit and scope of the claims.

What is claimed is:

1. A computer-implemented method of controlling vehicular traffic flow in a transport system, said method comprising:

defining a plurality of queues through the transport system such that a queue is defined for each possible track of travel through the transport system, wherein the transport system includes at least one intersection of a plurality of roads, and wherein each queue is defined by an origin point at an entrance to the intersection and a destination point at an exit for the intersection;

assigning each of a plurality of vehicles into one of the plurality of queues;

determining congestion in each queue; and permitting traffic flow in at least one queue that facilitates reducing the congestion in at least one queue.

2. A method in accordance with claim 1 further comprising determining a location and intended track of travel of at least one of the plurality of vehicles in the transport system.

3. A method in accordance with claim 2 wherein determining a location of at least one vehicle comprises triangulating an RFID signal associated with the vehicle.

4. A method in accordance with claim 2 wherein determining a location and intended track of travel of at least one of the plurality of vehicles comprises determining an intended track of travel of the at least one vehicle using the determined location of the vehicle.

5. A method in accordance with claim 2 wherein determining a location and intended track of travel of at least one of the plurality of vehicles comprises determining an intended track of travel of the at least one of the plurality of vehicles using an input from the vehicle.

6. A method in accordance with claim 5 wherein determining an intended track of travel comprises determining an intended track of travel using at least one of a turn signal from the at least one vehicle, a steering signal from the at least one vehicle, and an actual track of the at least one vehicle.

7. A method in accordance with claim 1 further comprising uniquely identifying at least one of the plurality of vehicles using an RFID enabled device.

8. A method in accordance with claim 2 wherein assigning each of a plurality of vehicles into one of the plurality of queues comprises assigning each of the plurality of vehicles into one of the plurality of queues based on the determined location and intended track of travel of the vehicle.

9. A method in accordance with claim 1 wherein determining congestion in each queue comprises determining a number of vehicles in each queue and a period of time each vehicle remains in the queue.

10. A method in accordance with claim 1 wherein permitting traffic flow comprises permitting traffic flow in at least one queue that facilitates reducing the total congestion of the plurality of queues.

11. A method in accordance with claim 1 wherein permitting traffic flow comprises permitting traffic flow in at least one queue such that a maximum wait time is not exceeded.

12. A method in accordance with claim 11 wherein the maximum wait time is selectable to represent at least one of a maximum total wait time and a maximum vehicle wait time.

13. A method in accordance with claim 1 wherein defining a plurality of queues through the transport system comprises defining a plurality of queues regardless of whether a vehicle is present in each queue.

14. A method in accordance with claim 1, wherein the transport system includes a plurality of intersections.

15. A method of controlling vehicular traffic flow through at least one intersection of roads, said method comprising:

determining a queue for each possible track of travel through the intersection, wherein each queue is defined by an origin point at an entrance to the intersection and a destination point at an exit of the intersection;

determining congestion in each queue; and permitting flow in one or more queues to facilitate minimizing congestion.

16. A method in accordance with claim 15 further comprising determining a location of each vehicle approaching the intersection.

17. A method in accordance with claim 16 further comprising determining a correction for determining the congestion based on an inability to locate at least one vehicle approaching the intersection.

18. A method in accordance with claim 16 further comprising determining a possible track of travel for each vehicle approaching the intersection using the determined location.

19. A method in accordance with claim 16 wherein determining a location of each vehicle approaching the intersection comprises determining a location of each vehicle approaching the intersection using a unique identifier associated with a respective vehicle.

20. A method in accordance with claim 16 wherein determining a location of each vehicle comprises receiving radio frequency signals from an RFID enabled device associated with each vehicle.

21. A method in accordance with claim 15 further comprising determining a possible track of travel for each vehicle approaching the intersection using a directional signal received from the vehicle.

22. A method in accordance with claim 15 further comprising associating each vehicle with a queue.

23. A method in accordance with claim 15 further comprising determining an average arrival time of vehicles approaching the intersection.

24. A method in accordance with claim 15 wherein determining congestion in each queue comprises:

determining a number of vehicles in each queue;

determining an amount of time each vehicle is in each queue; and determining a total queue time using the determined number of vehicles in each queue and the determined amount of time each vehicle is in each queue.

25. A method in accordance with claim 15 wherein permitting flow in one or more queues comprises permitting flow in one or more queues such that congestion in a plurality of queues is facilitated being minimized.

26. A method in accordance with claim 15 wherein permitting flow in one or more queues comprises permitting flow in one or more queues such that total congestion in all of the queues is facilitated being minimized.

* * * * *